US006138999A

United States Patent [19]

Gombinsky

[11] Patent Number: 6,138,999

[45] Date of Patent: Oct. 31, 2000

[54] PICTURE FRAME CLAMP

[76] Inventor: Abraham Gombinsky, 202 E. 21 St., New York, N.Y. 10010

[21] Appl. No.: 09/395,138

[22] Filed: Sep. 13, 1999

[51] Int. Cl.[7] ..... B25B 1/20

[52] U.S. Cl. ..... 269/41; 269/152

[58] Field of Search ..... 269/41, 152, 153, 269/154, 155, 46

[56] References Cited

U.S. PATENT DOCUMENTS

| | | | |
|---|---|---|---|
| 575,909 | 1/1897 | Schuler | 269/152 |
| 4,019,270 | 4/1977 | Trowbridge . | |
| 5,730,433 | 3/1998 | Veres . | |

FOREIGN PATENT DOCUMENTS

| | | | |
|---|---|---|---|
| 561201 | 8/1958 | Canada | 269/41 |
| 567909 | 4/1973 | Switzerland | 269/41 |
| 0616014 | 8/1958 | U.S.S.R. | 269/41 |
| 1352980 | 5/1974 | United Kingdom | 269/41 |

*Primary Examiner*—David A. Scherbel
*Assistant Examiner*—Daniel G. Shanley
*Attorney, Agent, or Firm*—Charles W. Chandler

[57] ABSTRACT

Two picture frame members can have their beveled end surfaces glued together by using a clamp mechanism to force the frame members into pressure contact at the end surfaces. The clamp mechanism includes a stationary stop member having a convex V-shaped edge surface contacting inner edges of the frame members, and a movable clamp member having a concave V-shaped edge surface contacting the outer edges of the frame members. Prongs on the stationary stop member prevent undesired shifting of the frame members while the clamp member is being advanced to exert pressure forces on the frame members.

2 Claims, 3 Drawing Sheets

PICTURE FRAME CLAMP

BACKGROUND AND SUMMARY OF THE INVENTION

This invention relates to a clamp for two picture frame members that are being glued together along a miter joint. The clamp is designed to exert a relatively high pressure on the frame members and surfaces that form the miter joint, to reduce the gluing time and provide a relatively strong glue joint. Optimally, the miter joint can be created solely by gluing, without the necessity for mechanical fasteners. The clamp is designed to be a relatively low cost, rugged tool that can be manually operated to achieve a fast cycle time between the unclamped condition and the clamped condition.

In the past, clamps have been used for assembling picture frames. U.S. Pat. No. 4,019,270 issued to Leonard D. Trowbridge, shows a clamp assembly that includes four comer clamp elements attached to four diagonal straps. An actuator screw is used to draw the straps toward the picture frame axis, whereby the corner clamp elements exert pressure on the outer edges of the picture frame members.

U.S. Pat. No. 5,730,433 issued to John Veres, shows a picture frame clamp that includes a slider 6 having prongs 15 engageable with the inner edges of the two picture frame members that are positioned against two stationary stops 4,4. As the prongs engage the inner edges of the picture frame members, the prongs are intended to deflect slightly toward the slider 6 axis, thereby sliding the picture frame members along stops 4,4. The intent is to achieve a relatively high pressure at the miter joint. There is some doubt that prongs 15 can produce the desired effect on a consistent basis.

The present invention concerns a picture frame clamp, wherein a stationary stop engages the inner edges of two picture frame members; and a movable clamp member is advanced toward the stationary stop to exert clamping pressures on the outer edges of the picture frame members. The movable clamp member has a concave V-shaped clamp surface, such that the clamp member generates opposing inwardly directed pressures against the picture frame members. As a result, the mating end surfaces of the frame members are forced tightly together to achieve intimate contact between the miter joint surfaces and the glue. Excess glue is squeezed out of the miter joint, so that curing time is somewhat shortened. In experimental situations, miter joint pressures on the order of one thousand p.s.i. have been achieved, using an apparatus of the present invention. Strong miter glue joints have been consistently obtained, using only glue as the connecting medium (i.e. without nails, brads or other mechanical fasteners).

Further features of the invention will be apparent from the attached drawings and description of an illustrative embodiment of the invention.

DESCRIPTION OF A PREFERRED EMBODIMENT OF THE INVENTION

Figure 1:
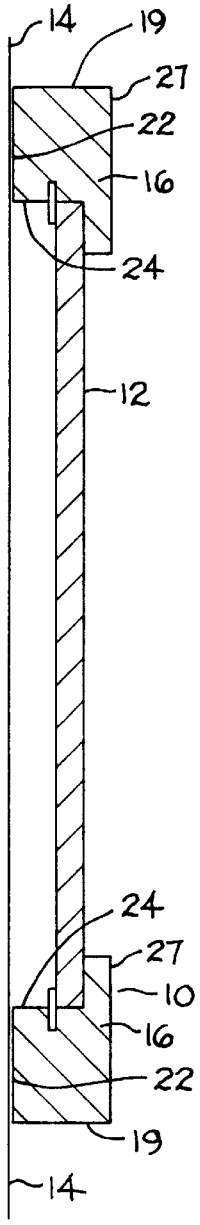
FIG. 1 is a sectional view taken through a picture frame that can be assembled, using a clamping mechanism of the present invention.
Figure 2:
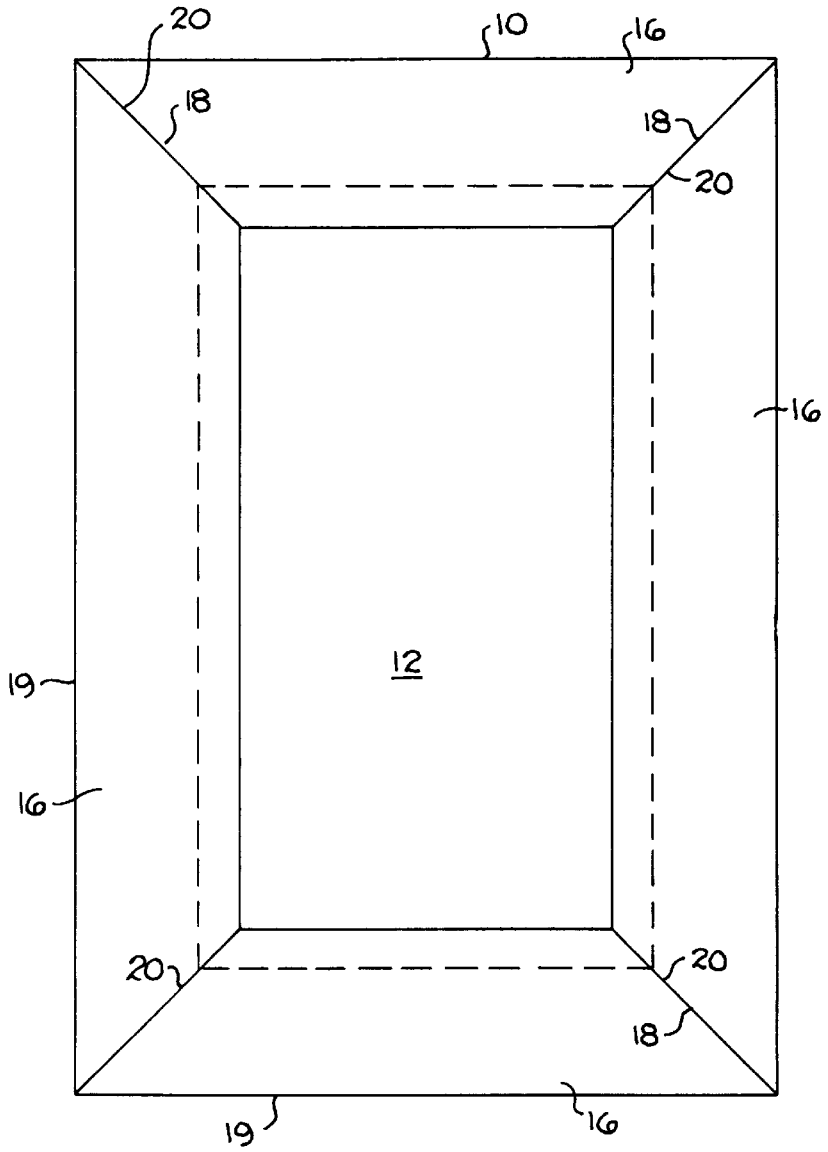
FIG. 2 is a front elevational view of the picture frame depicted in FIG. 1.

FIGS. 1 and 2, show a rectangular frame 10 for displaying a picture 12 on a vertical room wall surface 14. The frame comprises four individual frame members 16 having beveled ends 18 angled at forty-five degrees to the frame member length. The abutting ends 18 on adjacent frame members are joined together by glue, to form four mitered joints 20.

The rear surface 22 of each frame member 16 is rabbetted, as at 24, to form an internal support surface for picture 12. As shown in FIG. 1, front surface 27 of each frame member conceals the raw edge of picture 12. The illustrated picture frame is conventional.

FIGS. 3 through 7 show a clamping mechanism for gluing the four mitered joints together, to thereby form the picture frame of FIGS. 1 and 2. As shown in FIG. 1, the clamping mechanism comprises a stationary base that includes two parallel rails 30, 30 spaced equidistantly from a central longitudinal axis 32. The rightmost ends of rails 30 are rigidly connected together by a rectangular transverse wall 34. The leftmost ends of rails 30, 30 are rigidly connected together by a flat plate 36 spanning the rail upper surfaces. Screws or welding can be used to secure plate 36 to rails 30, 30.

Figure 6:
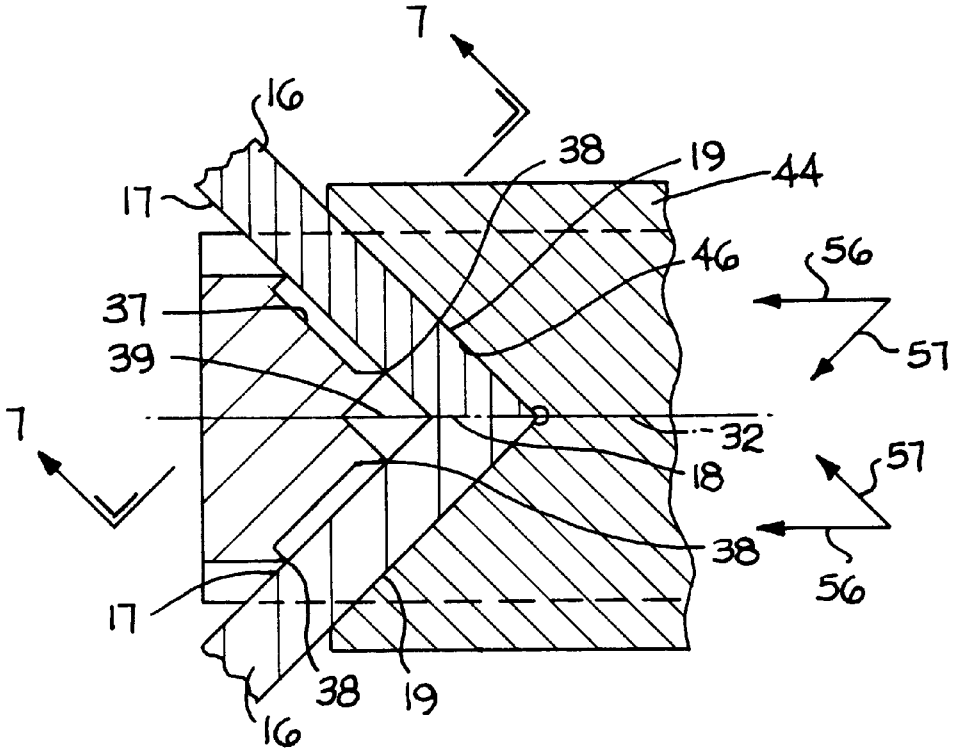
FIG. 6 is a fragmentary sectional view taken on line 6—6 in FIG. 4.

Plate 36 has a convex V-shaped edge surface 36 adapted to engage the inner edges 17 of two frame members 16 placed on the upper surfaces of rails 30, 30. As shown in FIG. 6, the V-shaped edge surface has four sharpened prongs 38 that are adapted to penetrate the inner edges 17 of the two frame members 16, to preclude them from longitudinal displacement off of rails 30. The apex portion of V-shaped edge surface 37 is cut, as at 39, to minimize the possibility that the beveled ends of members 16 might not have the desired abutting relationship.

Figure 3:
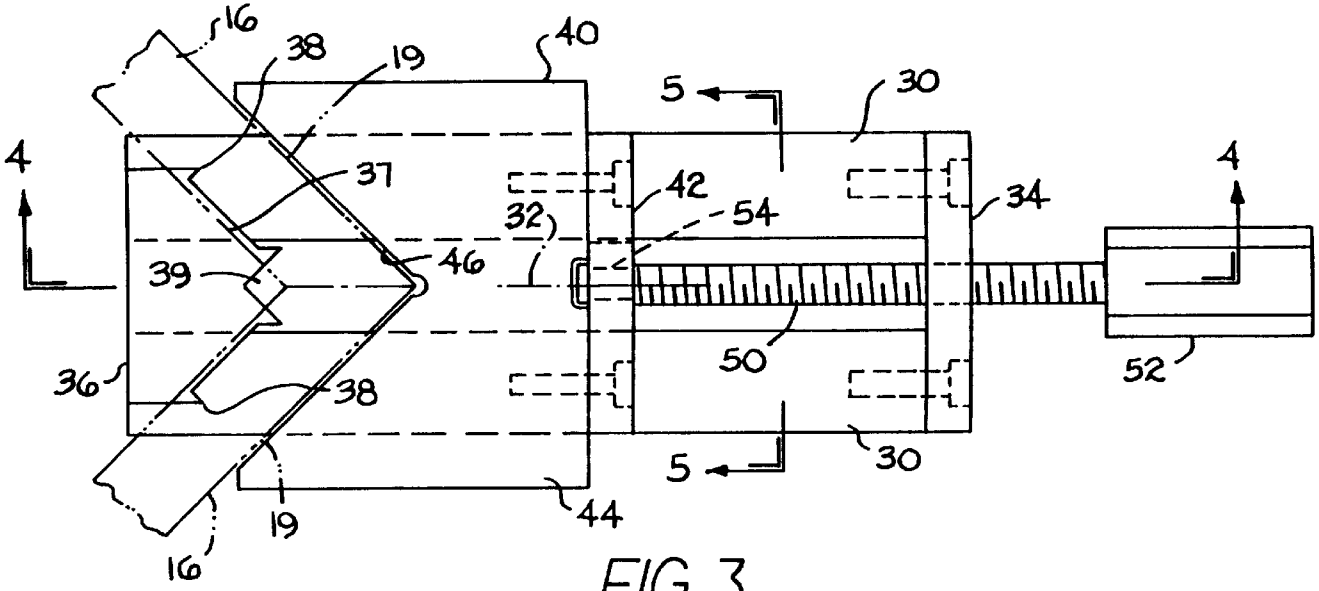
FIG. 3 is a plan view of a clamping mechanism embodying the invention.

Each prong 38 has a V-shape, as shown in FIGS. 3 and 6. One leg of each V extends parallel to central longitudinal axis 32; the other leg of each V is angled to central axis 32 at approximately forty-five degrees. These other legs are normal to inner edge surfaces 17 of the frame members to form miniature abutments that resist outward shifting of each frame member when prongs 38 penetrate surfaces 17. Plate 36 forms a stationary stop member for frame members 17.

V-shaped edge surface 37 comprises two surface areas angled at forty-five degrees to central axis 32, such that V-shaped surface 37 is symmetrical around axis 32.

Figure 4:
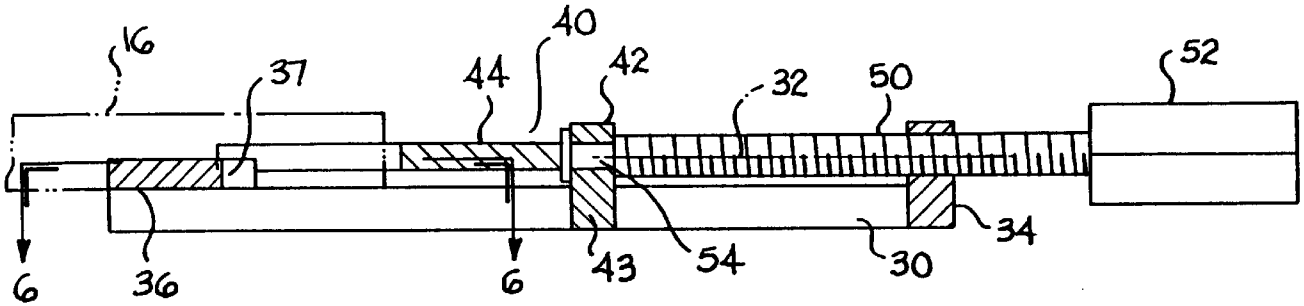
FIG. 4 is a sectional view taken on line 4—4 in FIG. 3.
Figure 5:
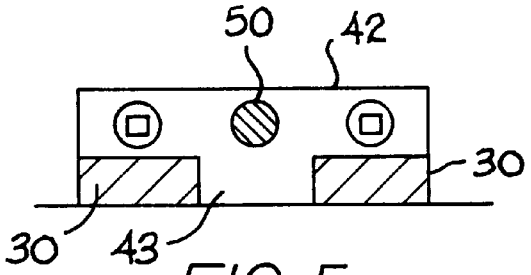
FIG. 5 is a transverse sectional view taken on line 5—5 in FIG. 3.

The clamp mechanism further comprises a movable clamp member 40 mounted for slidable motion above rails 30, 30 along a movement axis that coincides with central axis 32. The illustrated clamp member comprises a transverse wall element 42 slidable on the upper surfaces of rails 30, 30. As shown in FIG. 4, wall element 42 has a depending section 43 located between the rails to guide the wall element along the rails.

Clamp member 40 further includes a flat panel 44 extending horizontally from wall element 42 for engagement with the outer edges 19 of frame members 16. The left edge 46 of panel 44 has a concave V-shaped configuration that is symmetrical around the central movement axis of the clamp member. Panel 44 can be secured to wall element 42 by screws or welding.

Clamp member 40 is advanced toward stop (plate) 36 by means of a manual screw 50 that extends from wall element 42 through a threaded hole in transverse wall 34. The right end of the screw is attached to a knob 52. The left end of screw 50 has a swivel connection 54 with wall element 42.

Manual rotation of knob 52 rotates screw 50 so that the screw threads through the hole in wall 34 to advance clamp member 40 toward the pronged edge surface 37 on stationary plate 36. Prongs 38 keep frame members 16, 16 in fixed positions on rails 30, while concave V-shaped edge 46 on panel 44 exerts pressure forces on outer edges 19 of the frame members.

Referring to FIG. 6, movement of clamp member 40, as indicated by arrow 56, produces force vectors in the direction 57, i.e. normal to the associated frame member edge 19. The opposing force vectors 57 act in opposing directions on frame members 16, such that beveled ends 18 of the frame members enjoy pressurized contact with each other. Prongs 38 on stop plate 36 penetrate the inner edges of frame members 16 to prevent such reactive motions of frame members 16 as might reduce the contact pressure between end surfaces 18. High contact pressures between end surfaces 18 contribute to a more intimate contact between the glue and end surfaces 18; the result is a stronger glue bond between the frame members.

Figure 7:
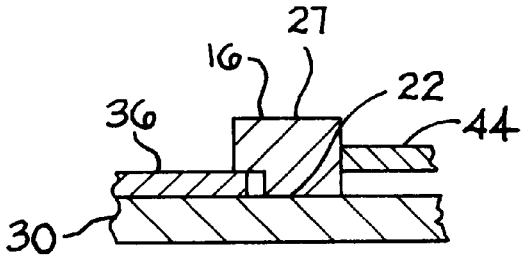
FIG. 7 is a fragmentary sectional view taken on line 7—7 in FIG. 6.

It will be noted from FIG. 7 that movable panel 44 is located in a plane that is slightly above the plane of stop plate 36. The upward offsetting of panel 44 from plate 36 enables panel 44 to contact frame member 16 on a plane approximately midway between surfaces 22 and 27 of the frame member; this is desirable to minimize any tendency of the frame member to become unseated from the rails 30. Stop plate 36 engages the inner edge of frame member 16 in a concealed location, where any indentations produced by prongs 38 are concealed, i.e. not visible when picture 12 is being displayed.

Having described my invention, I claim:

1. A clamp mechanism for exerting a clamp force on a miter joint between two picture frame members while the frame members are being glued together along the miter joint; said clamp mechanism comprising:

a stationary stop member having a central axis alignable with the miter joint, and a convex V-shaped stop surface symmetrical around said central axis for pressure engagement with the inner edges of the picture frame members;

a movable clamp member having a movement axis coincident with the central axis of the stationary stop member, and concave V-shaped clamp surface symmetrical around said movement axis for pressure engagement with the outer edges of the picture frame members;

said convex V-shaped stop surface comprising multiple prongs facing said concave side of the concave V-shaped clamp surface;

a flat support surface for the picture frame members;

said stationary stop member comprising a flat plate located on said support surface so that said prongs are contiguous to said support surface; and said movable clamp member comprising a flat panel spaced from said support surface for engaging the picture frame members on a plane offset from the plane of said flat plate.

2. The clamping mechanism of claim 1, wherein said convex V-shaped stop surface comprises multiple prongs facing said V-shaped clamp surface; each prong having a V-shaped cross section, wherein one leg of the V is parallel to said central axis, and the other leg of the V is angled to said central axis at forty five degrees.

* * * * *